US010099348B2

(12) United States Patent
Gupta

(10) Patent No.: US 10,099,348 B2
(45) Date of Patent: Oct. 16, 2018

(54) BEAD HANDLING TONGS WITH REAMER

(71) Applicant: DPG USA Inc., Schaumburg, IL (US)

(72) Inventor: Nikhil Gupta, Schaumburg, IL (US)

(73) Assignee: DPG USA INC., Schaumburg, IL (US)

( * ) Notice: Subject to any disclaimer, the term of this patent is extended or adjusted under 35 U.S.C. 154(b) by 0 days.

(21) Appl. No.: 15/895,225

(22) Filed: Feb. 13, 2018

(65) Prior Publication Data

US 2018/0229347 A1 Aug. 16, 2018

Related U.S. Application Data

(60) Provisional application No. 62/459,028, filed on Feb. 14, 2017.

(51) Int. Cl.

| | |
|---|---|
| ***B25B 7/22*** | (2006.01) |
| ***B25F 1/00*** | (2006.01) |
| ***B25B 7/02*** | (2006.01) |

(52) U.S. Cl.

CPC ..... *B25B 7/22* (2013.01); *B25B 7/02* (2013.01); *B25F 1/003* (2013.01)

(58) Field of Classification Search

CPC ..... B25B 7/02; B25B 7/22; B25B 9/02; B25F 1/003

USPC ..... 294/3, 16, 99.2; 81/7, 8, 426.5; 7/900

See application file for complete search history.

(56) References Cited

U.S. PATENT DOCUMENTS 157,293 A * 12/1874 Pitt
456,221 A * 7/1891 Meehan
1,171,221 A * 2/1916 Marion ..... B25F 1/003 7/128
1,176,604 A * 3/1916 Sanders ..... B25B 7/02 294/99.2
1,501,816 A * 7/1924 Seppmann ..... B25B 27/04 29/213.1
2,111,195 A * 3/1938 Skau ..... B25F 1/003 294/99.2
3,321,736 A * 5/1967 Flynn ..... H01R 11/24 294/99.2
4,938,514 A * 7/1990 D'Addezio ..... A61M 5/3213 128/919
D717,536 S * 11/2014 Gupta ..... D28/55
2005/0167999 A1* 8/2005 Beal ..... A61J 1/16 294/16

* cited by examiner

*Primary Examiner* — Dean J Kramer
(74) *Attorney, Agent, or Firm* — Robert S. Alexander; Ferrells, PLLC; Anna L. Kinney

(57) ABSTRACT

A bead manipulating tongs is provided. The tongs have a pair of elongated polymeric clenching arms, a polymeric clamp being formed on the interior surface of at least one of the elongated clenching arms, and a bead manipulating tool grasped by the polymeric clamp. The elongated clenching arms have a generally U-shaped profile with the open portion of the U of each arm facing the other, the uprights of the U on each arm forming a generally perimetral wall about a portion thereof. An interruption is formed in the perimetral wall of the elongated clenching arm proximate the polymeric clamp. The head of the bead manipulating tool is congruent to the interruption in the perimetral wall of the elongated clenching arm. A spring positioned between the elongated clenching arms urges one end of each of the elongated clenching arms into engagement with an end of the other elongated clenching arm.

2 Claims, 6 Drawing Sheets

BEAD HANDLING TONGS WITH REAMER

CLAIM FOR PRIORITY

This Non-Provisional patent application is based on U.S. Provisional Patent Application Ser. No. 62/459,028, filed on Feb. 14, 2017, the priority of which is claimed, and the disclosure of which is incorporated by reference.

BACKGROUND OF THE INVENTION

Beading has become a widely enjoyed pastime for large numbers of people. Using relatively simple tools and inexpensive beads, beaders produce a wide variety of inexpensive decorative items often given to their friends and family. An important demographic for beading is senior citizens, particularly older women who enjoy making ear rings, necklaces, bracelets, bangles and other items for their grandchildren and their friends. With this particular demographic, the unavoidable infirmities of advanced age can increasingly interfere with their enjoyment of this pastime, particularly when arthritis, rheumatism, and failing dexterity make manipulations of beads increasingly difficult.

SUMMARY OF THE INVENTION

This invention relates to tongs specifically designed for beading having a facility in their handle for storing a bead reamer. In particular, this reamer comprises a pair of lightweight elongated polymeric tongs having elongated clenching arms joined to each other at a hinge with at least 2 contoured bead grasping recesses formed in each clenching arm at one end thereof with said clenching arms being urged into engagement with a spring and separable by urging the other ends of said clenching arms together. A pair of contoured bead grasping recesses is formed in each clenching arm, each recess comprising a generally hemispherical recess formed in its respective clenching arm with a transverse intersecting generally semi-cylindrical trench passing therethrough. When the clenching arms are urged into engagement by the spring, each of the pair of contoured grasping recesses in each clenching arm abut one another defining a pair of generally spherical cavities located on the longitudinal axis of the clenching arms while the semi-cylindrical trenches passing therethrough also align forming intersecting cylindrical bores oriented generally transverse to the longitudinal axis of the clenching arms and passing therethrough. In general, the diameter of the spherical cavities is at least 20%, more preferably 30%, still more preferably 40% and most preferably about 50% larger than the diameter of the cylindrical bores.

To facilitate handling of a wide variety of bead sizes, one pair of generally hemispherical or ellipsoidal recesses will have a diameter exceeding that of the other pair of generally hemispherical or ellipsoidal recesses by at least about 20%, more preferably 30%, still more preferably 40% and most preferably about 50%. Similarly the diameter of each trench in one pair of generally cylindrical trenches will exceed the diameter of the trenches in the other pair by at least about 20%, more preferably 30%, still more preferably 40% and most preferably at least about 50%. Generally medially along the length of the elongated clenching arms, inwardly projecting mateable stanchions will be formed in each whereby the previously mentioned hinge can be formed. In some instances, the stanchion or stanchions on one elongated clenching arm will have a retaining recess formed therein and the stanchion or stanchions on the other will have a post or rod projecting therefrom so that a hinge can be formed by urging the post or rod into the retaining recess. In other cases, the stanchions can have superposeable throughbores formed therethrough so that an axle or hinge rod may be inserted to form the hinge.

In general, the profile of each clenching arm as viewed looking down the longitudinal axis thereof will be hollowed out and roughly U-shaped with the upright legs of the U defining a perimetral wall spanning over substantial portion of its perimeter. At least one of said clenching arms will have formed therein in the end opposed to the grasping end thereof and disposed on the upper lateral surface of the "bottom" of the U, a polymeric clamp mateable with a beading tool chosen from the group consisting of bead reamers, bead positioning tools as depicted in Gupta U.S. Design Pat. D703,941 issued May 6, 2014, and beading needles. An interruption will be formed in the terminal portion of the perimetral wall of the elongated clenching arm having a polymeric clamp formed therein proximate said polymeric clamp. The beading tool will have a head formed thereupon configured to supplant the missing portion, so that a comfortable grasp will be experienced by the user thereof. In some cases, the handle portion of the elongated clenching arm will have a softer polymeric layer overmolded thereupon to further complement graspability by the user.

The particular shape of the bead grasping recesses is such that beads, even when initially disposed imperfectly with respect to the recesses, will be urged into the central spherical portions of the bead grasping recess as the clenching arms are allowed to approach each other under the influence of the spring. In some cases, the diameter of the generally semi-cylindrical trenches may increase slightly as the trench approaches the hemispherical recess to further urge the bead into the hemispherical recess without it being retained in the semi cylindrical trench. This further eases the facility with which the user may grasp a bead.

Combination of these bead grasping tongs with a self-storing reamer is particularly advantageous as the combination of a spherical cavity with a generally cylindrical throughbore enables the user to ream out the bore while the bead is firmly retained in the hemispherical cavity. Because the cavity holding the bead is generally spherical, the tendency for the bead to become dislodged during the reaming process is greatly reduced as compared to the situation in which a bead might be held by a pair of tweezers or the like.

Other aspects and advantages of the present invention are described in the detailed description below and in the claims.

BRIEF DESCRIPTION OF THE DRAWINGS

The invention is described in detail below with reference to the appended drawings, wherein like numerals designate similar parts. In the Figures.

DETAILED DESCRIPTION OF THE INVENTION

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art. Terminology used herein is given its ordinary meaning consistent with the exemplary definitions set forth immediately below.

Figure 1:
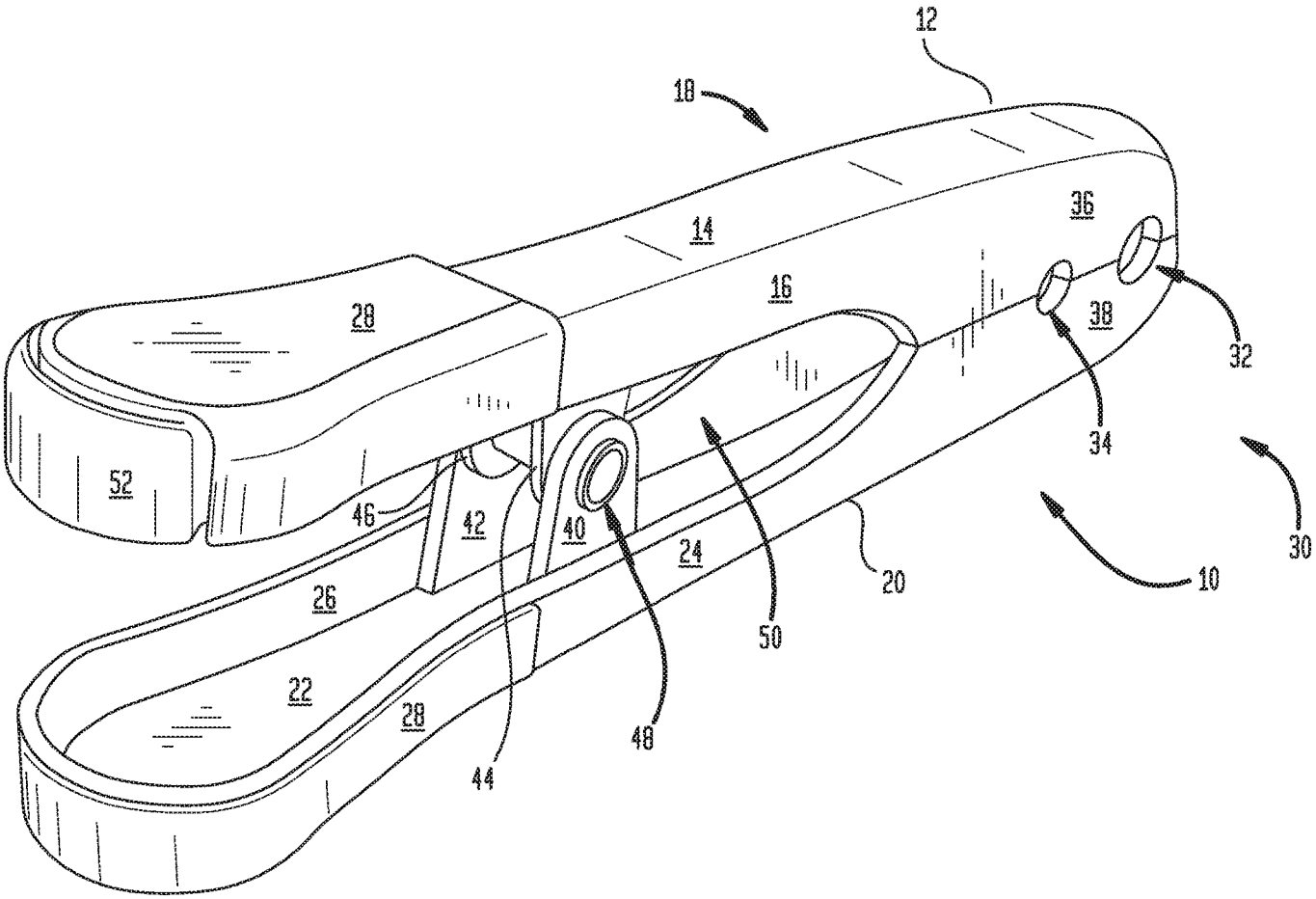
FIG. 1 is a schematic isometric perspective of the bead grasping tongs of the present invention wherein the stanchions forming the hinge as well as the removable head of the bead manipulating implement is visible.
Figure 2:
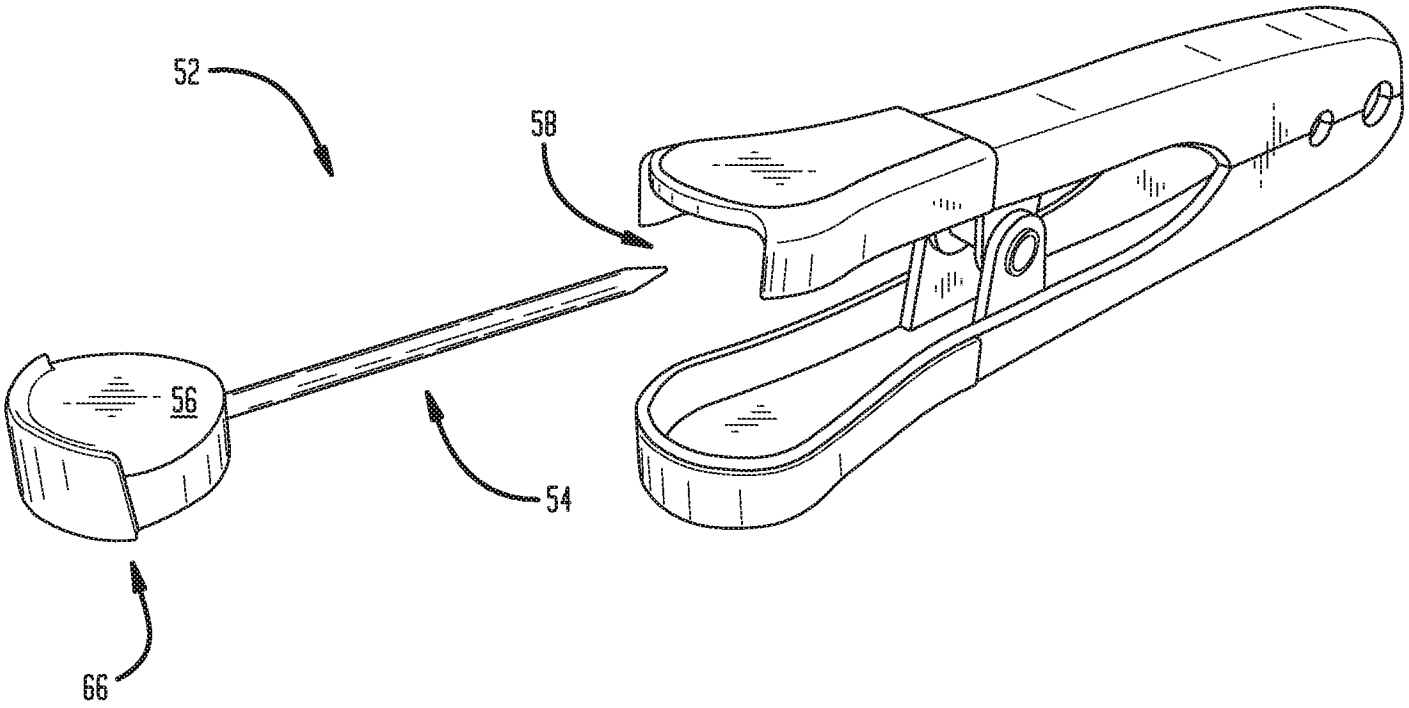
FIG. 2 is a similar schematic isometric perspective to FIG. 1 with the bead manipulating implement withdrawn. By comparison of FIGS. 1 and 2, it can be appreciated how the head of the bead manipulating implement is congruent to the interruption in the perimetral wall of the upper elongated clenching arm.
Figure 3:
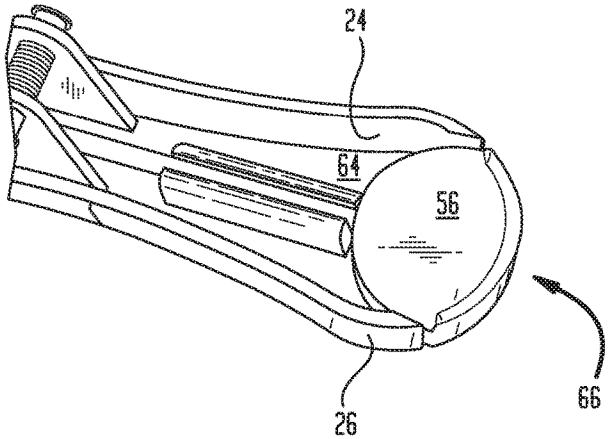
FIG. 3 is a partial isometric perspective of the elongated clenching arm having the polymeric clamp formed therein and illustrating the head and shaft of the bead manipulating implement in the stored position.
Figure 4:
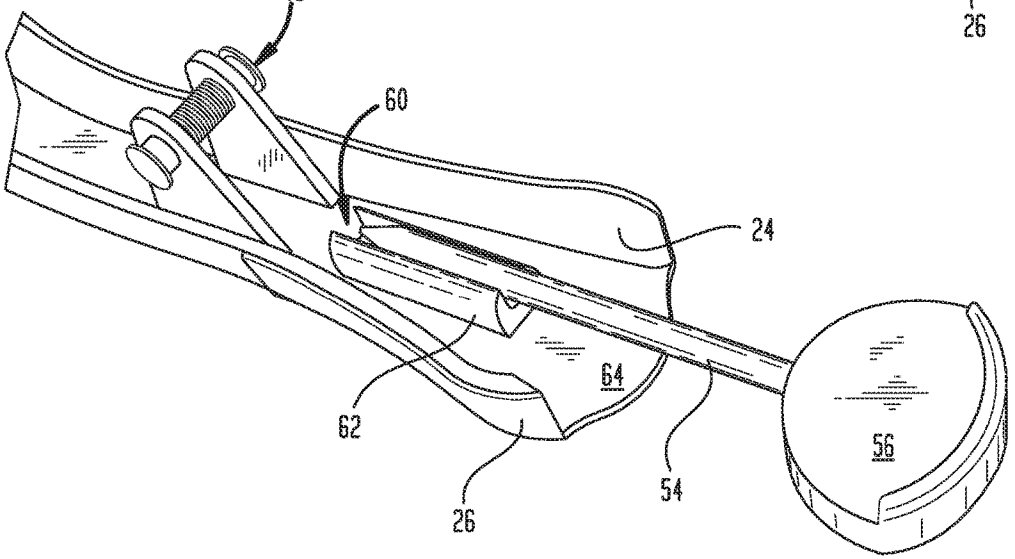
FIG. 4 is a partial isometric perspective similar to FIG. 3 except that the bead manipulating implement is partially withdrawn.
Figure 5:
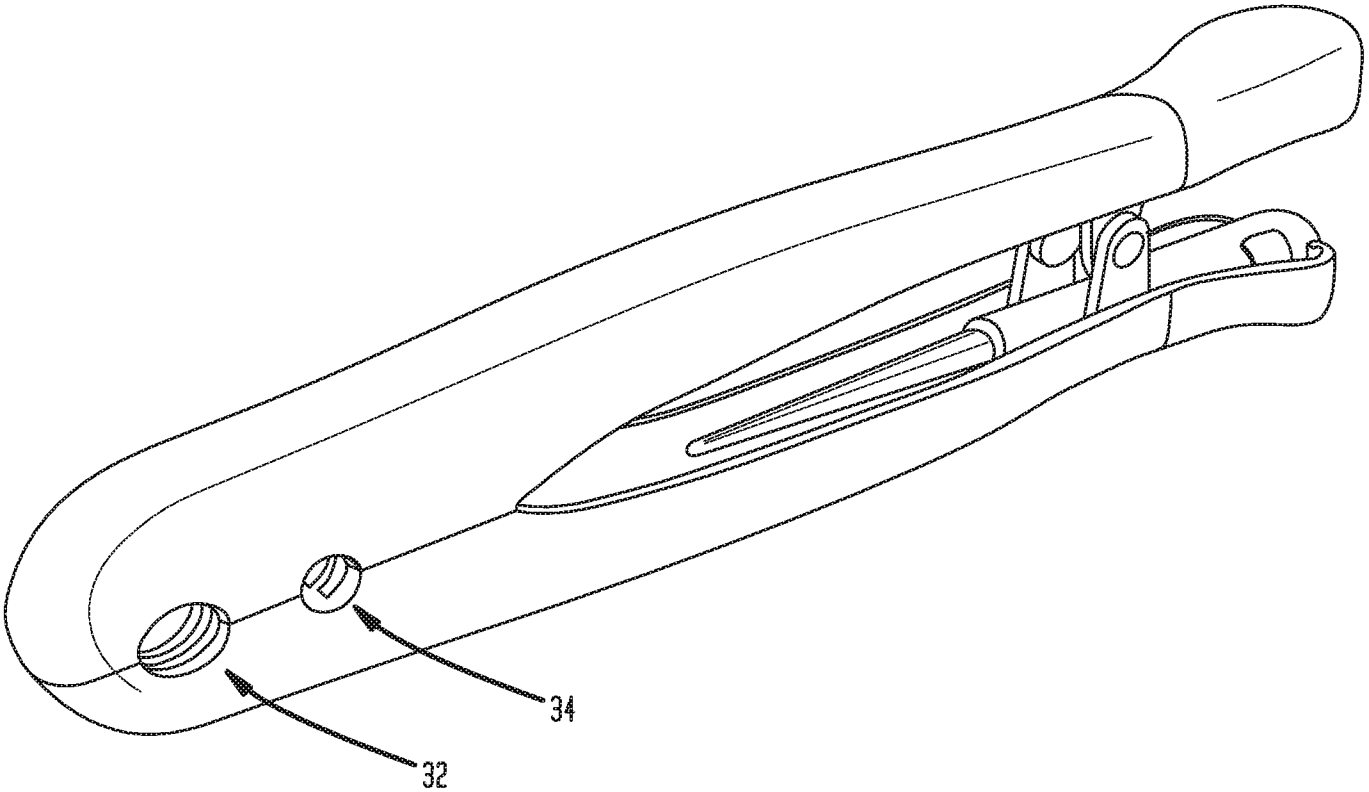
FIG. 5 is a schematic isometric perspective of an alternative embodiment of the bead grasping tongs of the present invention.
Figure 6:
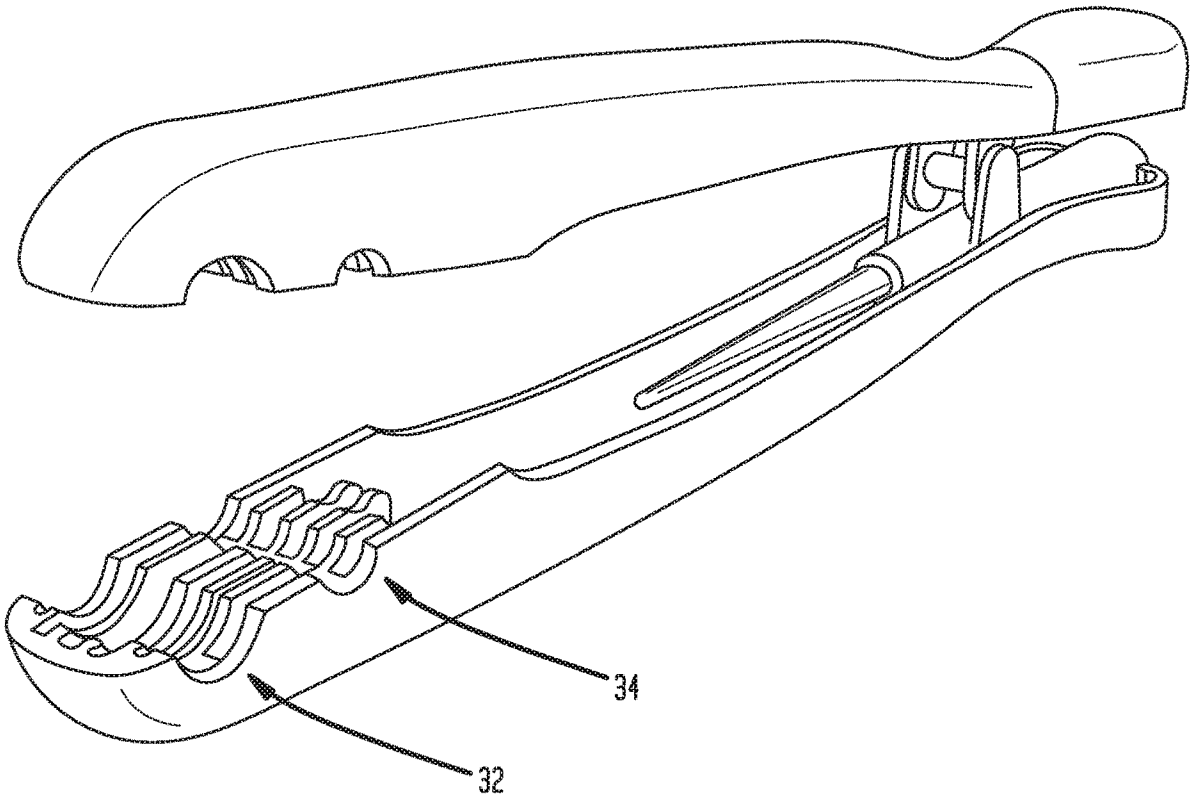
FIG. 6 is a schematic isometric perspective of the alternative embodiment of the bead grasping tongs of the present invention with the jaws in the opened position illustrating the bead grasping recesses.
Figure 7:
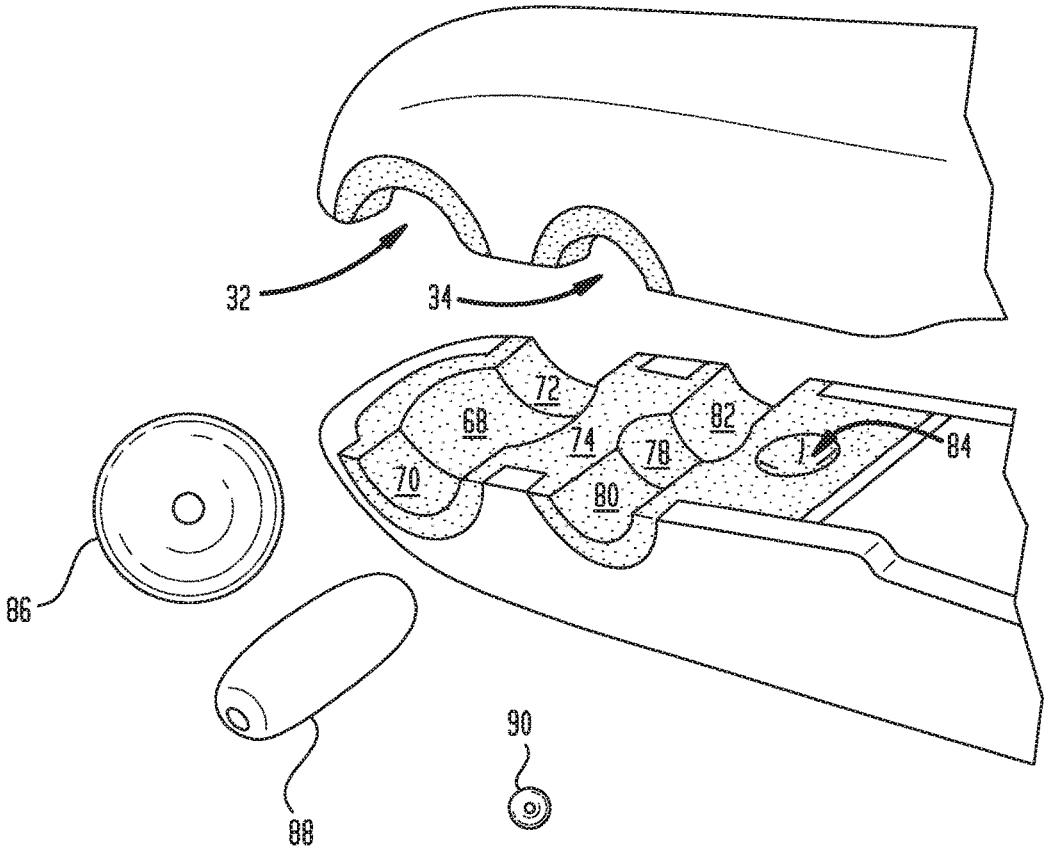
FIG. 7 is a schematic isometric perspective of the bead grasping tongs of the present invention illustrating the bead grasping recesses and the over-molded soft polymeric layer in which the recesses are formed while also illustrating how the recesses are configured to receive a variety of sizes and shapes of beads.

In FIG. 1, bead handling tongs 10 are illustrated comprising upper member 12, having web 14 disposed between sidewalls 16, 18, and lower member 20, having web 22 disposed between sidewalls 24, 26, both upper member 12 and lower member 20 being molded from a rigid polymeric material having cushions 28 overmolded thereupon of a softer polymeric material to facilitate handling. At working end 30 of tongs 10, bead grasping recesses 32 and 34 are visible even though jaws 36 and 38 of bead handling tongs 10 are closed. Lower stanchions 40 and 42 are formed on lower member 20 while inner stanchions 44 and 46 are formed on upper member 12 with axle 48 passing through stanchions 40, 42, 44 and 46 and forming pivotable joint whereby jaws 36 and 38 may be urged out of engagement by pressing overmolded cushions 28 together against the resistance of spring 50. In FIG. 2, bead reamer 52 comprising abrasive coated rod 54 and grasping tab 56 has been withdrawn from reamer nesting recess 58. Reamer nesting recess 58 can, of course, be formed in either upper member 12 or lower member 20. In FIGS. 3 and 4, bead reamer 52 is retained by U-shaped channel 60 in mounting bracket 62 formed on interior surface 64 of lower member 20. As illustrated, grasping tab 56 is configured to form congruous surface 66 with sidewalls 24, 26 of lower member 20. FIG. 5 illustrates an alternative embodiment of bead handling tongs 10 in which interior surfaces 64 of bead grasping recesses 32 and 34 are ribbed as more clearly illustrated in FIG. 6. FIG. 7 is a detailed view illustrating bead handling recess 32 comprising ellipsoidal bead grasping cavity 68 disposed between channels 70 and 72 formed in polymeric overmolding 74 while bead handling recess 34 comprising ellipsoidal bead grasping cavity 78 disposed between channels 80 and 82 is formed in polymeric overmolding 74 proximally spaced from bead handling recess 32 while minor bead handling cavity 84 is formed in overmolding 74 spaced still further proximally from bead handling recess 32. Typical beads 86, 88 and 90 are depicted to illustrate how large spherical bead 86 is accommodated in bead handling recess 32 while lozenge-shaped bead 88 is readily accommodated in bead handling recess 34 while small spherical bead 90 is accommodated in minor bead grasping cavity 84. To facilitate handling of various sizes of beads, one pair of generally hemispherical or ellipsoidal grasping cavity 68 will have a diameter exceeding that of generally hemispherical or ellipsoidal grasping cavity 78 by at least about 20%, more preferably 30%, still more preferably 40% and most preferably about 50%. Similarly the diameter of each trench or cylindrical channel 70 and 72 will exceed the diameter of the cylindrical channels or trenches 80 and 82 in the other pair by at least about 20%, more preferably 30%, still more preferably 40% and most preferably at least about 50%.

While the invention has been described in detail, modifications within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

As my invention, I claim:

1. A bead manipulating tongs comprising a pair of elongated polymeric clenching arms having a generally U-shaped profile with the open portion of the U of each arm facing the other, the uprights of the U on each arm forming a generally perimetral wall about a portion of each arm, each elongated clenching arm having a generally medially positioned stanchion formed therein extending upwardly from the bottom of its U, said stanchions being capable of being brought into engagement to form a hinge, a spring positioned between said elongated clenching arms urging one end of each of said elongated clenching arms into engagement with an end of the other elongated clenching arm, a pair of generally hemispherical grasping recesses being formed in the ends of each elongated clenching arm urged into engagement by action of said spring, each said hemispherical grasping recess being transected by a generally semi cylindrical trench extending across the width of said elongated grasping arm, one of said pair of hemispherical grasping recesses being substantially larger than the other, the diameter of said hemispherical grasping recess being substantially larger than the diameter of the transecting semi cylindrical trench, a polymeric clamp being formed on the interior surface of at least one of said elongated clenching arms and a bead manipulating tool, grasped by said polymeric clamp, an interruption being formed in the perimetral wall of said elongated clenching arm proximate said polymeric clamp, a head of said bead manipulating tool being congruent to the interruption in the perimetral wall of said elongated clenching arm.

2. The bead manipulating tongs of claim 1, wherein the bead manipulating tool is a reamer.

* * * * *